US008961752B2

(12) United States Patent
Eberle et al.

(10) Patent No.: US 8,961,752 B2
(45) Date of Patent: Feb. 24, 2015

(54) FILTER DEVICE FOR PURIFYING FLUIDS

(75) Inventors: Richard Eberle, Ormesheim (DE); Markus Dewes, Oberthal (DE)

(73) Assignee: Hydac Filtertechnik GmbH, Sulzbach/Saar (DE)

( * ) Notice: Subject to any disclaimer, the term of this patent is extended or adjusted under 35 U.S.C. 154(b) by 1 day.

(21) Appl. No.: 13/138,959

(22) PCT Filed: Apr. 22, 2010

(86) PCT No.: PCT/EP2010/002464

§ 371 (c)(1), (2), (4) Date: Nov. 22, 2011

(87) PCT Pub. No.: WO2010/127770

PCT Pub. Date: Nov. 11, 2010

(65) Prior Publication Data

US 2012/0067720 A1 Mar. 22, 2012

(30) Foreign Application Priority Data

May 2, 2009 (DE) ..... 10 2009 019 744

(51) Int. Cl.

| | |
|---|---|
| ***C25B 9/00*** | (2006.01) |
| ***C25B 9/20*** | (2006.01) |
| ***B01D 35/30*** | (2006.01) |
| ***C10G 31/09*** | (2006.01) |
| ***C10G 32/02*** | (2006.01) |
| ***C10G 27/00*** | (2006.01) |

(52) U.S. Cl.

CPC ..... *C10G 31/09* (2013.01); *C10G 32/02* (2013.01); *C10G 2300/201* (2013.01); *C10G 27/00* (2013.01)

USPC ..... 204/276; 204/242; 210/106; 210/203; 210/294; 210/323.1; 210/348; 210/747.3

(58) Field of Classification Search

CPC ..... C25B 9/00; C25B 9/20; B01D 35/30

USPC ..... 204/276, 242; 210/106, 203, 294, 210/323.1, 348, 747.3

See application file for complete search history.

(56) References Cited

U.S. PATENT DOCUMENTS

| | | | | |
|---|---|---|---|---|
| 5,141,714 | A | 8/1992 | Obuchi et al. | |
| 5,630,915 | A * | 5/1997 | Greene et al. | 204/164 |
| 6,596,174 | B1 | 7/2003 | Marcus | |
| 7,278,542 | B2 | 10/2007 | Dussaud et al. | |
| 7,316,857 | B1 * | 1/2008 | Swanson et al. | 429/421 |
| 2004/0261313 | A1 | 12/2004 | Burrington et al. | |
| 2008/0014417 | A1 * | 1/2008 | Izumi et al. | 428/195.1 |
| 2008/0156642 | A1 * | 7/2008 | Fryda et al. | 204/261 |
| 2008/0283446 | A1 | 11/2008 | Tatarchuk et al. | |

FOREIGN PATENT DOCUMENTS

| | | |
|---|---|---|
| DE | 20 2005 003 720 | 7/2006 |
| WO | WO 2004/004869 | 1/2004 |
| WO | WO 2009/050163 | 4/2009 |

* cited by examiner

*Primary Examiner* — Zulmariam Mendez

(74) *Attorney, Agent, or Firm* — Roylance, Abrams, Berdo & Goodman LLP

(57) ABSTRACT

A filter device purifies fluids, especially fuels contaminated with organic substances. Hydroxyl radicals are formed from water molecules contained in the fluids by a separating device (10, 14, 22). The hydroxyl radicals oxidize the impurities, especially organic substances, as much as possible and convert them into compounds such as $CO_2$.

9 Claims, 2 Drawing Sheets

FILTER DEVICE FOR PURIFYING FLUIDS

BACKGROUND OF THE INVENTION

The invention relates to a filter device for purifying fluids, in particular fuels contaminated with organic matter.

FIELD OF THE INVENTION

To ensure the operational reliability of drive units supplied with liquid fuels, such as internal combustion engines in particular, purification of the fuels is essential. To protect the sensitive injection systems against damage, organic substances and particles remaining within the pertinent filter device as fouling must be separated by filter arrangements from diesel fuels. In addition to entrained portions of water, the fuels are often also contaminated with organic substances and particles.

The replacement intervals of filter arrangements generally depend on the flow resistance produced by the pertinent filter arrangement. As fouling of the filter increases, the differential pressure generated across the filter medium and consequently the flow resistance increases.

SUMMARY OF THE INVENTION

An object of the invention is to provide a filter device for the purification of fluids, especially of fuels, that is simple and economical to operate and enables a long service life of the filter media of the filter device.

This object is basically achieved by a filter device having a separator separating the water molecules contained in the fluid, especially the fuel, such that hydroxyl radicals are formed. Since hydroxyl radicals are chemically highly reactive oxidants, organic substances are for the most part oxidized by contact with hydroxyl radicals.

While organic substances in particle form cause a high flow resistance in filter devices, this result is not the case in the oxides formed by oxidation, for example $CO_2$. This phenomenon is known, for example, with respect to soot particle filters in the exhaust line of internal combustion engines. Oxidation to ash is initiated by regeneration of the filter, generally by supplying heat, to reduce these particles to ash and $CO_2$. Similarly, in fluid filter devices, the invention calls for "cold" oxidation by hydroxyl radicals. As a result, a purification device has economical operating behavior, especially with respect to the reduction of filter changing intervals.

With respect to producing the hydroxyl radicals, preferably the separator has media acting as a catalyst and forming hydroxyl radicals, and/or an electrolysis apparatus.

In catalytically operating separator, titanium dioxide is used with particular advantage as a catalyst on or in the filter medium of a filter element belonging to the filter device.

The arrangement can be advantageously made such that titanium dioxide is applied as a layer to the filter medium.

The effectiveness of the catalyst can be easily and advantageously enhanced by the catalyst being exposed to light radiation, especially in the wavelength range from 180 to 300 nm.

In this respect, the filter device can have a housing part forming a window for radiation entry of natural light or light produced by an artificial radiation source to the catalyst on the filter medium.

Alternatively, in a housing part of the filter device sealed radiation tight, a radiation source can be within the housing part.

In an electrolytically operating separator, the electrolysis apparatus can have at least one diamond electrode acting as anode in the electrolysis within a housing part accommodating a filter element.

In advantageous exemplary embodiments, the diamond electrode can be formed on an end cap of the filter element.

To complete the electrolysis apparatus, electrically conductive components of the filter medium can be formed in particular from high-grade steel, or components of other parts of the filter element can form the cathode of the electrolysis apparatus.

With respect to making contact with the electrodes acting as anode and cathode, the arrangement disclosed in DE 10 2004 005 202 A1 can be used for connection of a DC voltage source effecting electrolysis.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

In the electrolysis of water, the water is conventionally split into hydrogen and oxygen. By special electrodes, for example, a diamond electrode acting as anode and electrically conductive due to doping with the element boron, a special water decomposition can be achieved in which highly reactive hydroxyl radicals are formed instead of oxygen and hydrogen. Instead of the separation by an electrolysis apparatus, hydroxyl radicals can be produced by a catalyst in contact with the entrained water molecules, for which titanium dioxide is very well suited. Using FIG. 1, the invention is explained using one example in which the water molecules are separated by the catalyst formed by titanium dioxide.

Figure 1:
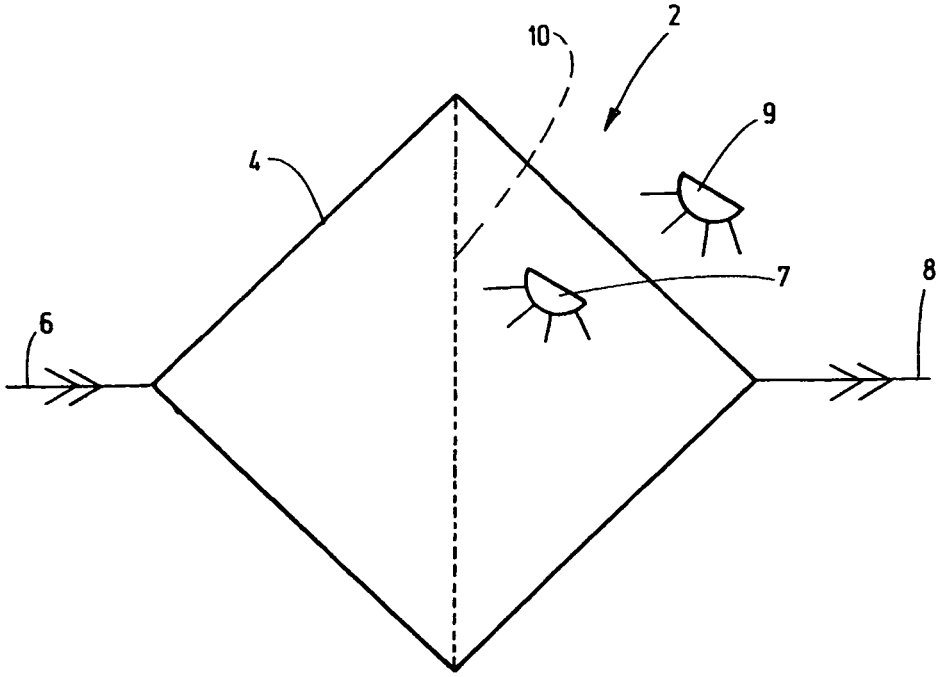
FIG. 1 is a schematic and simplified diagrammatic representation of a device according to exemplary embodiments of the invention, with a catalytically operating separator where two possible alternatives of the supply of light radiation are indicated.

In this context, in FIG. 1 a filter device 2 is shown only by a symbol. A fuel feed line 6 and a fuel drain line 8 are connected to the filter housing 4. In the housing 4, a filter medium 10 is located. To separate the water into hydrogen and hydroxyl radicals, the filter medium 10 is provided with a layer of titanium dioxide acting as catalyst.

To enhance the catalytic action of the titanium dioxide located in the filter housing 4 and the formation of the hydroxyl radicals, a supply of electromagnetic radiation, in this case in a wavelength range from 180 to 300 nm, is provided. FIG. 1 shows two possible alternatives of the radiation supply. In one case, an internal light source 7 is within the filter housing 4. Although only one light source 7 is shown in the drawings, several light sources in suitable arrangement and of any design, for example, one or more LEDs can be provided in the filter housing 4.

In the alternative embodiment, a radiation transmitting wall part on the filter housing 4 forms a preferably UV-transmitting window through which the titanium dioxide can be irradiated by an external light source 9. This external light source 9 can be formed by natural light or, as for the internal light source 7, by one lamp or several lamps of any design as well as radiating bodies of any type, preferably, likewise by LEDs.

By oxidation of organic fouling, "cold" oxidation prevents an overly rapid buildup of the flow resistance of the filter device 2 by rising differential pressure on the filter medium 10. The filter service life is then extended.

Figure 2:
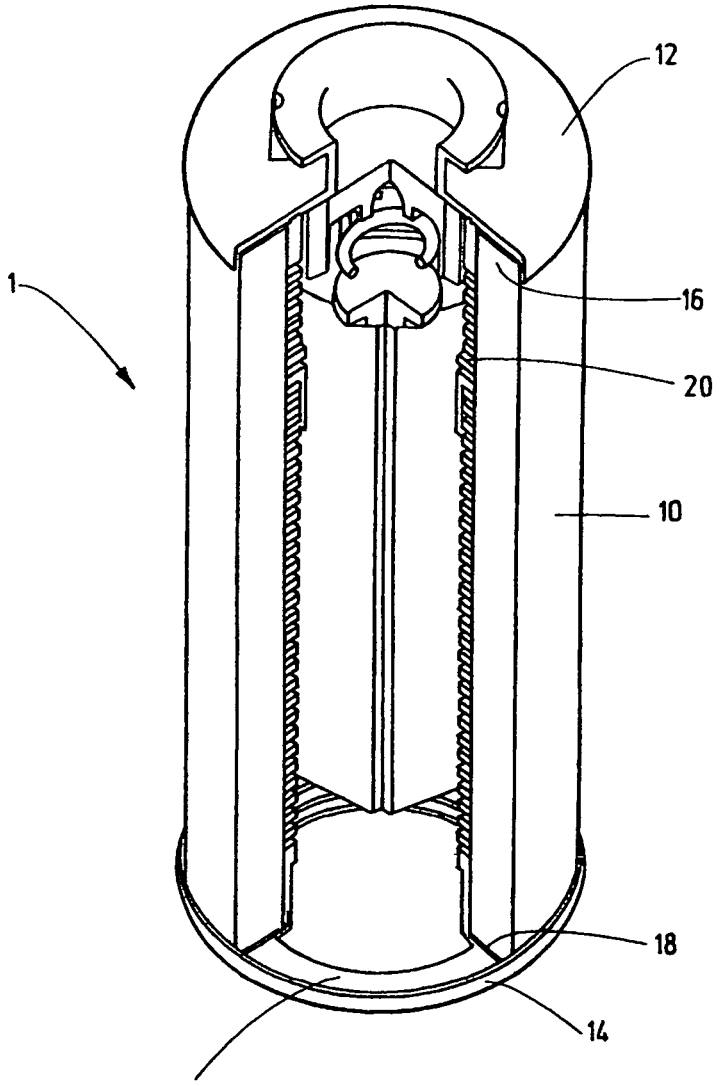
FIG. 2 is a partially cutaway perspective view of a filter element according to one exemplary embodiment of the invention having an electrolytic separator.

In the exemplary embodiment of FIG. 2, the separator operates electrolytically. The filter element 1 shown in FIG. 2 has a filter medium 10 extending between two end caps 12, 14, each connected to an assignable end region 16, 18 of the filter medium 10. Between the end region 16 and the end cap 12, an adhesive bed 26 forms an insulating layer. The other end region 18 of the filter medium 10 is permeable to fluids toward the inside of the lower end cap 14. The filter medium 10 is supported on the inner peripheral side on a support pipe 20.

The lower end cap 14 on its inside forms a diamond electrode 22 acting as anode in operation. The diamond electrode is a crystalline diamond layer of only few nanometers thickness on the electrically conductive end cap 14. The diamond is rendered electrically conductive by doping with the element boron. The electrochemical behavior of the diamond electrode 22 during electrolysis with an electrode acting as cathode, especially one made of high-grade steel, leads to a separation of water molecules such that highly reactive hydroxyl radicals are formed instead of hydrogen and oxygen.

With respect to the formation of the electrode acting as anode, for example, a high-grade steel lattice layer within the filter medium 10 can be built up in several layers as a filter mat.

With respect to making contact, as known from DE 10 2004 005 202 A1, several types of constructions for contact-making arrangements on filter elements are disclosed and can be adapted to the circumstances in the operation of an electrolysis apparatus.

Regardless of whether a catalytic separation of water molecules or an electrolysis is carried out to separate water molecules into highly reactive hydroxyl radicals and hydrogen, oxidation of organic substances to the greatest extent possible takes place by contact with hydroxyl radicals. This oxidation leads to "cold ashing" of organic particles with escape of $CO_2$ and minor amounts of remaining ash residues, that do not cause any significant rise of flow resistance when they remain on the filter medium.

While various embodiments have been chosen to illustrate the invention, it will be understood by those skilled in the art that various changes and modifications can be made therein without departing from the scope of the invention as defined in the appended claims.

What is claimed is:

1. A filter device for purifying fuels contaminated with organic matter, comprising:

a filter housing;

an electrolysis filter element forming hydroxyl radicals from water molecules contained in the fuel, the hydroxyl radicals oxidizing impurities including organic matter and converting the impurities into compounds including $CO_2$; and at least one diamond electrode acting as an anode during electrolysis within said housing, said diamond electrode being formed on an end cap of said filter element.

2. A filter device according to claim 1 wherein said filter element comprises a filter medium with a titanium dioxide catalyst thereon.

3. A filter device according to claim 2 wherein said titanium dioxide catalyst comprises a layer on said filter medium.

4. A filter device according to claim 2 wherein said catalyst is exposed to light radiation enhancing generation of the hydroxyl radicals.

5. A filter device according to claim 4 wherein said light radiation has a wavelength in a range from 80 to 300 nm.

6. A filter device according to claim 4 wherein said filter housing comprises a window allowing entry of at least one of natural light and light produced by an artificial radiation source into said housing to irradiate said catalyst.

7. A filter device according to claim 4 wherein a radiation source is located in said filter housing.

8. A filter device for purifying fuels contaminated with organic matter, comprising:

a filter housing;

an electrolysis filter element forming hydroxyl radicals from water molecules contained in the fuel, the hydroxyl radicals oxidizing impurities including organic matter and converting the impurities into compounds including $CO_2$, said filter element comprising a filter medium with electrically conductive components forming an electrolysis cathode; and at least one diamond electrode acting as an anode during electrolysis within said housing, said diamond electrode being formed on an end cap of said filter element.

9. A filter device wherein for purifying fuels contaminated with organic matter, comprising:

a filter housing;

an electrolysis filter element forming hydroxyl radicals from water molecules contained in the fuel, the hydroxyl radicals oxidizing impurities including organic matter and converting the impurities into compounds including $CO_2$, said filter element comprising a filter medium with electrically conductive components forming an electrolysis cathode, said conductive components comprise high-grade steel; and at least one diamond electrode acting as an anode during electrolysis within said housing, said diamond electrode being formed on an end cap of said filter element.

* * * * *